United States Patent [19]

McClure et al.

[11] Patent Number: 4,765,409

[45] Date of Patent: Aug. 23, 1988

[54] AUTOMATIC SEPARATION DEVICE FOR USE WITH WIRELINE CONVEYED PERFORATING GUN

[75] Inventors: Gerald B. McClure, Socorro, N. Mex.; William A. McPhee, Houston, Tex.

[73] Assignee: Western Atlas International, Inc., Houston, Tex.

[21] Appl. No.: 914,837

[22] Filed: Oct. 2, 1986

[51] Int. Cl.[4] ..... E21B 43/11

[52] U.S. Cl. ..... 166/297; 166/55.1; 285/3

[58] Field of Search ..... 166/297, 55, 55.1, 55.2, 166/117; 175/4.56, 4.5, 4.51, 4.52, 4.53, 4.55; 102/319, 321; 89/1.15; 285/3, 370

[56] References Cited

U.S. PATENT DOCUMENTS

| | | | |
|---|---|---|---|
| 2,957,414 | 10/1960 | Hodgson | 166/55 X |
| 2,965,031 | 12/1960 | Johns | 166/55 X |
| 3,246,707 | 4/1966 | Bell | 175/4.54 |
| 3,398,803 | 8/1968 | Leutwyler et al. | 166/297 X |
| 3,441,093 | 4/1969 | Boop | 175/4.55 |
| 3,966,236 | 6/1976 | Vann | 285/39 |
| 4,066,282 | 1/1978 | Vann | 285/39 |
| 4,179,991 | 12/1979 | Echols et al. | 285/370 X |
| 4,314,614 | 2/1982 | McPhee et al. | 166/55.1 |
| 4,601,492 | 7/1986 | George | 285/3 |

*Primary Examiner*—Stephen J. Novosad
*Assistant Examiner*—David J. Bagnell
*Attorney, Agent, or Firm*—Patrick H. McCollum

[57] ABSTRACT

Method and apparatus for automatically separating a wireline conveyed through-tubing perforating gun from a cable assembly. The gun is joined to a hollow sleeve on the cable assembly by a sub closely received in each end retained thereto by shear members. The force of the explosion upon firing the gun shears the shear members and drives the sub into the sleeve, allowing the gun to drop into the well.

7 Claims, 1 Drawing Sheet

AUTOMATIC SEPARATION DEVICE FOR USE WITH WIRELINE CONVEYED PERFORATING GUN

BACKGROUND OF THE INVENTION

This invention is concerned with a tubular, perforating gun of the kind which is lowered on a cable through and out the open end of a string of drill tubing into an oil or gas well for the purpose of firing explosive charges to perforate hydrocarbon bearing subsurface strata, and in particular with the automatic separation of such perforating gun, upon its firing, from the firing assembly with which it was lowered into the well.

When perforation of an oil (or gas) well is to be accomplished by use of a perforating gun lowered into the borehole through and out the open end of the string of tubing (commonly referred to as "throughtubing"), a gun must be selected which has an outside diameter which is at least slightly smaller than the inside diameter of the tubing. If the diameter of the gun is too small, however, the size, and consequent power of the charges carried therein is limited resulting in adequate penetration of the formation.

In order to carry the most powerful possible charge, and thus to obtain the greatest possible penetration into the subsurface strata, guns have typically been constructed to maximum size, i.e., with the closest possible tolerance in terms of ability to pass through the string of tubing. The problem frequently encountered, being that which is addressed by this invention, is that, after firing, the gun is deformed. The power of the explosion expands the gun distorting the original size and shape of its tubular body, and burrs appear around the ports out of which the charges are fired where the force of the shock wave, upon its exit from the gun, has given the rim of the port a slight bend or turn toward the outside of the gun. This distortion in the shape of the gun, opposes smooth passage back through the string of tubing, and makes retrieval an extremely difficult task. If the gun becomes stuck in the tubing, which is frequently the case, because the original close tolerance is no longer sufficient, the cable upon which it was lowered down through the tubing may pull loose, and all operations on the well must cease while an effort is made to "fish" the lodged gun out of the string of tubing. As can be appreciated, the occurrence of such a situation adds enormous cost and inconvenience to the effort to put a well into production.

The concept of dropping a spent gun off into the rathole of the well is known in the art. For example, U.S. Pat. Nos. 3,966,236 and 4,066,282 disclose apparatus for releasing a spent perforating gun which has been lowered into the borehole by attachment directly to the end of the string of tubing, the release apparatus being activated by a fishing tool lowered down through the string of tubing on a wire.

The invention described herein not only furnishes novel method and apparatus for automatically releasing a spent gun which has been lowered on a cable into the borehole through and out the open end of the string of tubing, it does so using the explosive power of the perforating gun rather than by trying in some fashion to focus, regulate or ameliorate the exterior effect of such explosive power on the many different ways in which the gun may be attached to the assembly on which it is lowered through the tubing.

SUMMARY OF THE INVENTION

Apparatus and method are herein furnished for the automatic separation of a perforating gun from the firing assembly upon the firing of the gun. A tubular sleeve is securely anchored at its end to the firing head of the perforating assembly. A close fitting sub is placed half within the bottom end of said sleeve and extending at least partially within the end of the gun. The sub is fastened to the walls, respectively, of the sleeve and the gun with shear members. The sub and shear members in this arrangement are sufficient to transfer the load of the weight of the gun to the sleeve, as support therefor. When the gun is fired, however, the shock wave of the explosive blast applies force against the sub, shearing the shear members, and shifting the sub into the sleeve, which allows the gun to drop into the well. This avoids having to retrieve a misshapen gun through the string of tubing, in a fashion which leaves no condition on the exterior of the firing assembly which would act as an impediment to the passage of the cable assembly back through the tubing string.

DETAILED DESCRIPTION OF THE PREFERRED EMBODIMENT

Figure 1:
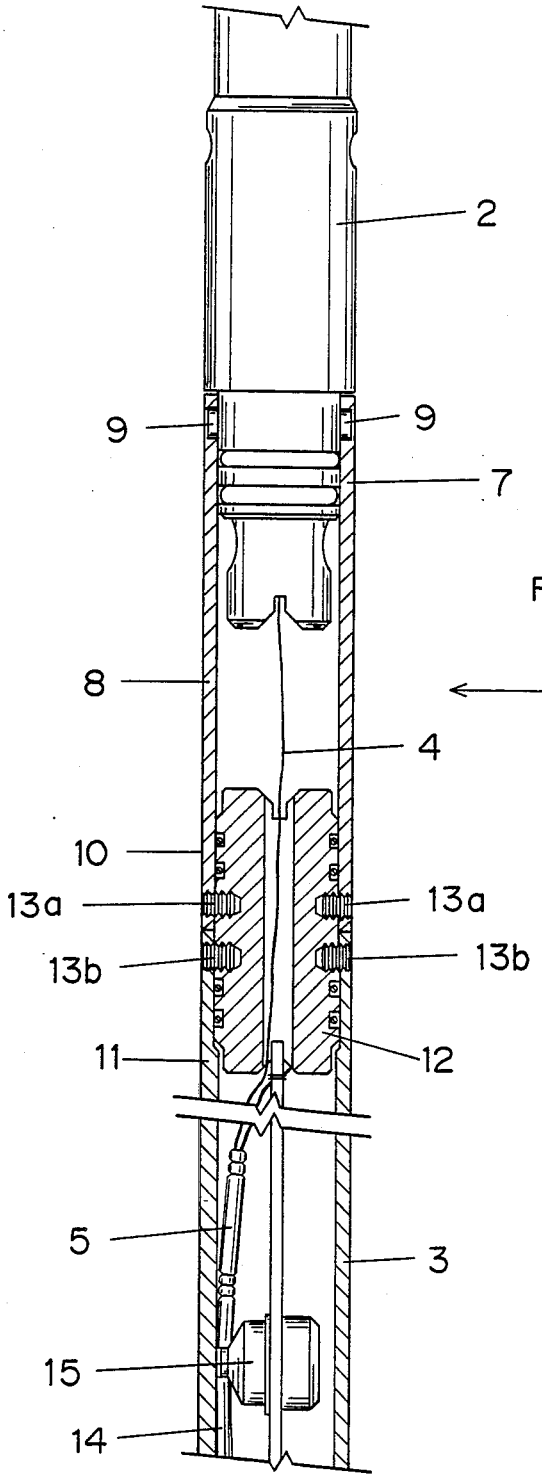
FIG. 1 is a longitudinal sectional view of a firing head to which a perforating gun, before firing, is attached by the apparatus disclosed in the present invention.

In FIG. 1 is shown a typical through-tubing perforating gun 1 of the kind which can be lowered on a cable down into the borehole of a well through, and out the open end of, the string of tubing (not shown). In the assembly shown in FIG. 1, the firing head 2 is above (i.e., closer to the earth's surface) the perforating gun 3 in the borehole, and the firing head 2 is part of the assembly (not shown) which is attached to the cable by which said assembly and the gun 3 have been lowered into the borehole through the string of tubing (not shown) in a manner common in the art. The firing head 2 is a typical electrically controlled firing head commonly used in the art. An electrical signal supplied to the firing head 2 is sent through electrical conductors 4 to a blasting cap 5, which ignites detonator fuse 14.

The firing head 2 is securely anchored to the top end 7 of a tubular coupling sleeve 8 by bolts 9. The sleeve 8 is fastened at its bottom end 10, to the top end 11 of the gun 3. The firing head 2, the sleeve 8 and the gun 3 all possess an outside diameter which allows their smooth passage through the string of tubing. The sleeve 8 at its bottom end 10, and the gun 3 at its top end 11, possess the same inside diameter.

A piston-type sub 12 is employed which has an outside diameter no smaller than necessary to allow it to be received and slidable within both the bottom end 10 of the sleeve 8 and the top end 11 of the gun 3. The sub 12 is positioned in the interior of the sleeve 8 and the gun 3 so that approximately half the length of the sub 12 is located within each. The sub 12 is attached at such position by nylon or brass bolts, which are inserted from the exterior of, in each case, the sleeve 8 and the gun 3, through the wall of each and into the sub 12. The force of the weight of the gun 3, hanging in the borehole before firing, is transferred through the sub 12 and the bolts **13*b* inserted in the gun to the bolts 13*a* inserted in the sleeve 8, and thence on through the sleeve 8**, the firing head 2 and the remainder of the assembly to the cable (not shown) which runs to the earth's surface.

The detonator fuse 14, which runs the length of the gun 3, is detonated by a blasting cap 5. The detonator fuse 14 in turn detonates the charges 15. The force of the explosion of the detonator fuse 14 and the shaped charges 15 is channeled principally in three directions, out of the ports in gun 3 caused by the shaped charges 15 and up and down the interior of the gun 3. The portion of the explosion shock wave which travels up toward the top end 11 of the gun 3 is sufficient to force the sub 12 against the shear members 13*a* and 13*b*, shearing the sheer members 13*a* and 13*b* and driving the sub 12 into the sleeve 8. As the shear members 13 shear and the portion of the sub 12 positioned within the gun 3 before firing leaves the gun 3 upon firing, the gun 3 automatically drops off the assembly 1 into the rathole of the well.

The embodiments of the invention in which an exclusive property or privilege is claimed are defined as follows:

1. An automatic decoupler for disconnecting a tubular perforating gun from a firing head in a wireline conveyed perforating apparatus, comprising:

a tubular coupling member having a first end fixedly coupled to said firing head and a second end coupled to said perforating gun;

a piston member moveable within said coupling member in response to the firing of said perforating gun; and means for automatically decoupling said perforating gun from said firing head in response to the movement of said piston member.

2. The apparatus of claim 1 wherein said piston member is moveable within said coupling member in response to explosive forces within said perforating gun.

3. The apparatus of claim 1 wherein said means for automatically decoupling further comprise means shearable by movement of said piston member.

4. The apparatus of claim 3 wherein said shearable means comprise a plurality of shear members to attach said piston member to said coupling member and to said perforating gun.

5. A method for automatically detaching a perforating gun from a firing head, in a wireline conveyed apparatus for perforating subsurface earth formations, comprising the steps of:

attaching said firing head to said perforating gun with a tubular coupling member having a piston member moveable therein in response to the firing of said perforating gun;

lowering said perforating gun and said firing head into a borehole;

detonating said perforating gun; and automatically detaching said perforating gun from said firing head in response to the movement of said piston member.

6. The method of claim 5 wherein said step of attaching said firing head to said perforating gun comprises the steps of:

attaching said firing head to a first end of said tubular coupling member;

attaching a second end of said tubular coupling member to a first end of said piston member received within said tubular coupling member; and attaching said perforating gun to a second end of said piston member received within said perforating gun.

7. The method of claim 6 further comprising the step of attaching said tubular coupling member and said perforating gun to said piston member using a plurality of shear members.

* * * * *